US006284722B1

(12) United States Patent
Yamaguchi et al.

(10) Patent No.: US 6,284,722 B1
(45) Date of Patent: Sep. 4, 2001

(54) HIGH-DENSITY GRANULATED DETERGENT COMPOSITION FOR CLOTHES

(75) Inventors: Shu Yamaguchi; Hitoshi Tanimoto; Masaki Tsumadori; Hiroyuki Yamashita, all of Wakayama (JP)

(73) Assignee: Kao Corporation, Toyko (JP)

( * ) Notice: Subject to any disclaimer, the term of this patent is extended or adjusted under 35 U.S.C. 154(b) by 0 days.

(21) Appl. No.: 09/142,748

(22) PCT Filed: Mar. 13, 1997

(86) PCT No.: PCT/JP97/00809

§ 371 Date: Sep. 15, 1998

§ 102(e) Date: Sep. 15, 1998

(87) PCT Pub. No.: WO97/33970

PCT Pub. Date: Sep. 18, 1997

(30) Foreign Application Priority Data

Mar. 15, 1996 (JP) ..... 8-59382

(51) Int. Cl.[7] ..... C11D 3/08; C11D 3/34

(52) U.S. Cl. ..... 510/357; 510/444; 510/445; 510/446; 510/498; 510/507

(58) Field of Search ..... 510/357, 444, 510/445, 446, 498, 507, 466

(56) References Cited

U.S. PATENT DOCUMENTS

| | | | | |
|---|---|---|---|---|
| 4,605,509 | * | 8/1986 | Corkill et al. | 252/131 |
| 5,489,392 | * | 2/1996 | Capeci et al. | 252/89.1 |
| 5,516,448 | * | 5/1996 | Capeci et al. | 252/89.1 |
| 5,554,589 | * | 9/1996 | Capeci | 510/444 |
| 5,565,137 | * | 10/1996 | Capeci | 510/216 |
| 5,691,291 | * | 11/1997 | Nassano et al. | 510/444 |
| 5,707,959 | * | 1/1998 | Pancheri et al. | 510/444 |
| 5,733,862 | * | 3/1998 | Capeci et al. | 510/444 |

FOREIGN PATENT DOCUMENTS

| | | |
|---|---|---|
| WO9218594 | 10/1992 | (EP) . |
| 0618290 A1 | 10/1994 | (EP) . |
| WO9502682 | 1/1995 | (EP) . |
| 0643130 A1 | 3/1995 | (EP) . |

OTHER PUBLICATIONS

English Language Abstract of JP No. 4–345700.
Patent Abstract of Japan Publication No. 6116588.
Derwent WPI English Abstract of JP 6041585.
Derwent WPI English Abstract of JP 9031491.

* cited by examiner

*Primary Examiner*—Kery Fries
(74) *Attorney, Agent, or Firm*—Birch, Stewart, Kolasch & Birch, LLP

(57) ABSTRACT

The present invention is targeted to obtain a high-density granular detergent composition for clothes washing having sufficient detergency even when the amount of dosage is small without lowering its detergency even after long-term storage by blending a non-soap anionic surfactant and a crystalline alkali metal silicate in a state of non-contact as much as possible. The high-density granular detergent composition for clothes washing, the granular detergent composition having a bulk density of from 0.7 to 1.2 g/cm$^3$, including (A) a non-soap anionic surfactant; (B) a crystalline alkali metal silicate; and (C) a metal ion capturing agent other than Component (B). In the above detergent composition, Component (A) is added in an amount of from 10 to 50% by weight, and a total amount of Component (B) and Component (C) is from 30 to 80% by weight, and a weight ratio of Component (B) to Component (C) is (B)/(C)=1/15 to 5/1, and at least a part of (B) the crystalline alkali metal silicate is blended in builder granules, the builder granules including the crystalline alkali metal silicate, a binder and optionally an aluminosilicate. Further, (A) the non-soap anionic surfactant is contained in the builder granules in an amount of less than 10% by weight.

22 Claims, 2 Drawing Sheets

HIGH-DENSITY GRANULATED DETERGENT COMPOSITION FOR CLOTHES

TECHNICAL FIELD

The present invention relates to a high-density granular detergent composition for clothes washing. More specifically, the present invention relates to a high-density granular detergent composition for clothes washing undergoing little deterioration after long-term storage and exhibiting excellent detergency even when a small amount is used.

BACKGROUND ART

Moreover, to date, various kinds of chelating agents, ion exchange materials, alkalizing agents, and dispersants have been known to be used for builders which are blended in detergents. Particularly, the phosphoric acid-based chelating agents comprising tripolyphosphates as a main component thereof have good water solubility and detergency, so that they have been formulated as main detergent builder ingredients.

In recent years, however, the use of tripolyphosphates has been decreased, since they are liable to cause eutrophication in closed water areas such as lakes and marshes. Instead, crystalline aluminosilicates (zeolites) have been commonly used as substitutes for the metal ion capturing agent, as typically disclosed in Japanese Patent Laid-Open No. 50-12381, of which the disclosure is incorporate herein by reference. Such detergents formulating zeolites as mentioned above would require a standard amount of dosage of 40 g per one washing cycle, the washing cycle being most commonly using about 30 L of the washing liquid per one cycle in Japan. Also, the powder detergents available at that time had a low bulk density at a level of 0.20 to 0.45 g/ml owing to the solubility in cold water. As a result, the standard volumetric amount is made as high as about 90 to about 200 ml of detergents per 30 L of water for washing, so that distribution is cumbersome between shops and households.

Therefore, an intense investigation has been made to produce compact detergents. For instance, Japanese Patent Laid-Open Nos. 62-167396, 62-167399, and 62-253699, of which the disclosure is incorporated herein by reference, disclose a remarkable decrease in the amount of crystalline inorganic salts such as sodium sulfate used as powdering aids conventionally contained in detergents. In addition, Japanese Patent Laid-Open Nos. 61-69897, 61-69899, 61-69900, and 5-209200, of which the disclosure is incorporated herein by reference, disclose that an increase in the bulk density of the detergents. By these findings, detergents having a bulk density of from 0.60 to 1.00 g/ml, whose standard a concentration is from 25 to 30 g/30 L, can be produced, thereby resulting in making the detergents compact to a level of a standard volumetric amount of from 25 to 50 ml/30 L.

On the other hand, crystalline alkali metal silicates having particular structure disclosed in Japanese Patent Laid-Open Nos. 5-184946 and 60-227895, of which the disclosure is incorporated herein by reference, shows not only good ion exchange capacity but also the action of the alkalizing agents (alkalizing ability). Therefore, possibility of more compact detergents has been studied because both of the functions which conventionally have been satisfied by two different components, including metal ion capturing agents, such as zeolites, and alkalizing agents, such as sodium carbonate, can be satisfied with the above crystalline alkali metal silicates alone.

For instance, Japanese Patent Laid-Open No. 6-116588, of which the disclosure is incorporated herein by reference, is concerned with a detergent composition containing a crystalline alkali metal silicate. In Examples of this publication disclosing a more compact detergent, even in a case where the amount of the detergent composition at washing is reduced by 25% by weight, the detergent composition has a washing power substantially the same as conventional detergent compositions. However, the composition is formulated based on the conventional washing principle, wherein the mainstream of the technical idea has been to make the oily components in dirt soluble by surfactants, and the composition is obtained by simple replacement of the alkalizing agent and the ion exchange material with the crystalline alkali metal silicate. Therefore, the ion exchange capacity are ascribed solely to the crystalline alkali metal silicates contained therein, so that the ion exchange capacity is insufficient for that needed for detergent compositions. In this case, the functions of the crystalline alkali metal silicates as alkalizing agents are prioritized over their functions as metal ion capturing agents, so that the washing power of the detergent composition is not always satisfactory, owing to the fact that the washing power of the detergent composition is dependent upon the water hardness of water for washing. Therefore, if the amount of dosage of the detergent composition were reduced, a good washing power is not able to be maintained.

A number of patent applications have been filed concerning the crystalline silicates disclosed in Japanese Patent Laid-Open No. 60-227895, of which the disclosure is incorporate herein by reference. Japanese Patent Unexamined Publication No. 6-502199, of which the disclosure is incorporate herein by reference, discloses a detergent comprising a layered crystalline silicate, a zeolite, and a polycarboxylate in particular proportions, to thereby provide a detergent which is free from providing film layer formation on fibers and has excellent washing power and bleaching agent stability. However, under the blending conditions given in this publication, when the amount of the detergents added was reduced at washing, the alkalizing ability is deficient because the amount of the crystalline alkali metal silicate in the builder composition is small, thereby making it impossible to maintain good washing power. Also, this publication never teaches the technical idea that an excellent washing power is exhibited in a small amount of dosage of detergents.

The technical idea that an excellent washing power is exhibited in a small amount of dosage of detergents as in the present invention cannot be found for detergents containing crystalline alkali metal silicates (crystalline layered silicates) disclosed in Japanese Patent Unexamined Publication 6-500141, Japanese Patent Laid-Open Nos 2-178398 and 2-178399, each of which the disclosure is incorporate herein by reference. Rather, in the case where the amounts of the detergent compositions shown in each of Examples are reduced, the washing power is lowered.

Japanese Patent Laid-Open No. 7-53992, of which the disclosure is incorporate herein by reference, discloses that the amount of dosage per cycle is reduced by formulating the layered crystalline silicate disclosed in Japanese Patent Laid-Open No. 60-227895, together with other builder components such as alkalizing agents and metal ion capturing agents, wherein the layered crystalline silicate is added in excess to the builder components. The technical idea disclosed herein is a conventional idea simply rephrasing that the alkalizing agents and the metal ion capturing agents added as two components are substituted with a single component of the crystalline alkali metal silicate, never suggesting any problems concerning a decrease in detergency after long-term storage.

In the prior art described above formulating the crystalline layered silicates, namely the crystalline alkali metal silicates, to the detergent compositions, the compositions are not known to have sufficient detergency. Moreover, when large amounts of the crystalline alkali metal silicates are formulated in powder detergents comprising anionic surfactants as the base surfactant components, the powder properties after a long-term storage and the detergency are likely to be lowered.

Accordingly, an object of the present invention is to provide a detergent composition for clothes washing exhibiting excellent detergency and undergoing remarkably little deterioration after a long-term storage.

These and other objects of the present invention will be apparent from the following description.

DISCLOSURE OF THE INVENTION

As a result of intense research in view of the above objects, the present inventors have found the relationship in an extremely simple washing system between the conditions for washing clothes and the detergency, and have developed a detergent composition showing excellent detergency with a small standard amount of dosage by analyzing the reason for excellent detergency in a particular high alkali, low water hardness washing conditions.

Specifically, while studying the washing liquid capable of showing good detergency, the present inventors have found that the higher the pH and the lower the water hardness, the lower the dependency of the detergency on the surfactant concentration, so that good detergency can be achieved. Also, in the case of a high pH but a high water hardness, the detergency is drastically lowered even at a high pH. In the case of washing solely with a composition containing a surfactant without containing any alkalizing agents, although the detergency at low water hardness is low, the dependency of the detergency on the water hardness is sufficient small when compared to systems containing alkalizing agents. From these results, the present inventors have proceeded with their studies on the relationship between the washing liquid and the dirt stains.

The sebum dirt stains which are the most typical dirt stains adhered to clothes contain fatty acids and glycerides, and the dirt stains are presumably a mixture of these organic materials with carbon, dirt, or peeled keratin. In the case of a high pH, while the content of the fatty acids increases by hydrolysis of glycerides, the reaction of the fatty acids with alkali metals to form salts also proceeds. The alkali metal salts of the fatty acids are soaps, and the salts of the fatty acids become easily dissolvable in the washing liquid with the dirt stains by making the washing liquid alkaline. On the other hand, the salts of the fatty acids, which are alkali metal salts, are notably more easily reactive with the calcium and magnesium ions in hard water as compared to the reactivity with the fatty acids, and this reaction is a competitive reaction with the freeing speed of the dirt stains in the washing liquid. The fatty acids and the salts of the fatty acids react with the hardness-increasing components in the hard water to form a scum not easily dissolvable in water, and the dirt stains are solidified without being freed from the interface of clothes and likely to be in a state not easily washed off. The scum formation rate becomes faster as the alkalizing ability increases. For the reasons given above, in the case where the pH is high and the water hardness is low, the washing liquids show excellent detergency, and in the case where the pH is high and the water hardness is high, the washing liquids show notably lowered detergency. Also, in the case where an alkalizing agent is not formulated, because the sebum dirt stains are washed only with washing power ascribed to the surfactants, the dependency of the detergency on the water hardness become comparatively lower than the systems containing alkalizing agents.

From these observations, the present inventors have found that one of the methods for reducing the standard amount of dosage of the detergents is to produce an environment of the washing liquid having low water hardness and high pH to thereby prevent the scum formation as much as possible, while utilizing the fatty acids in the dirt stains as soaps. Specifically, the present inventors have found a need to prepare detergent compositions of the present invention satisfy the compositional requirements by having the crystalline alkali metal silicate and other metal ion capturing agents in a particular blending ratio, each component being formulated in an amount of a particular range.

Further, as a result of intensive studies in the development of desired detergents, the present inventors have found that there is a tendency that the detergency after a long-term storage is lowered in a case where non-soap anionic surfactants are used as base surfactants, the non-soap anionic surfactants being typically exemplified by sodium alkylbenzenesulfonates most commonly formulated in powder detergents for clothes washing. The present inventors have found that the reasons for such lowered detergency are that the non-soap anionic surfactants are likely to react with the crystalline alkali metal silicates.

Based on the above findings, the present inventors have found that the resulting high-density granular detergent composition for washing clothes shows sufficiently high washing power even with a small amount of dosage and shows substantially no decrease in detergency after a long-term storage. The reasons for giving such effects are as follows: The crystalline alkali metal silicates and other metal ion capturing agents are blended in particular proportions in order to provide a washing liquid having a low water hardness and high pH. Also, the non-soap anionic surfactants and the crystalline alkali metal silicates are blended in a non-contact state as much as possible.

Specifically, the present invention is concerned with the following:

(1) a high-density granular detergent composition for clothes washing, the granular detergent composition having a bulk density of from 0.7 to 1.2 g/cm$^3$, comprising:
   (A) one or more non-soap anionic surfactants;
   (B) one or more crystalline alkali metal silicates; and
   (C) one or more metal ion capturing agents other than Component (B), wherein Component (A) is added in an amount of from 10 to 50% by weight, and a total amount of Component (B) and Component (C) is from 30 to 80% by weight, wherein a weight ratio of Component (B) to Component (C) is (B)/(C)=1/15 to 5/1, and wherein at least a part of the (B) crystalline alkali metal silicate is blended in the builder granules, the builder granules comprising the crystalline alkali metal silicate, a binder and optionally an aluminosilicate, and wherein (A) the non-soap anionic surfactant is contained in the builder granules in an amount of less than 10% by weight;

(2) the high-density granular detergent composition for clothes washing described in item (1) above, wherein a whole part of the Component (B) is blended in the builder granules:

(3) the high-density granular detergent composition for clothes washing described in item (1) or (2) above, wherein the binder is at least one member selected from the group consisting of polyoxyethylene alkyl ethers, fatty acids, fatty acid salts, and polyethylene glycols;

(4) the high-density granular detergent composition for clothes washing described in any one of items (1) to (3) above, wherein the crystalline alkali metal silicates have $SiO_2/Na_2O$ molar ratios of from 0.5 to 2.6;

(5) the high-density granular detergent composition for clothes washing described in any one of items (1) to (4) above, wherein the builder granules have an average particle size of from 250 to 1000 $\mu$m;

(6) the high-density granular detergent composition for clothes washing described in any one of items (1) to (5) above, wherein the crystalline alkali metal silicates have an average particle size of from 1 to 50 $\mu$m; and (7) the high-density granular detergent composition for clothes washing described in any one of items (1) to (6) above, wherein the non-soap anionic surfactants are at least one member selected from the group consisting of linear alkylbenzenesulfonates, $\alpha$-olefinsulfonates, $\alpha$-sulfofatty acid salts, methyl ester salts of $\alpha$-sulfofatty acids, alkyl sulfates, alkenyl sulfates, and polyoxyethylene alkyl ether sulfates.

Figure 2:
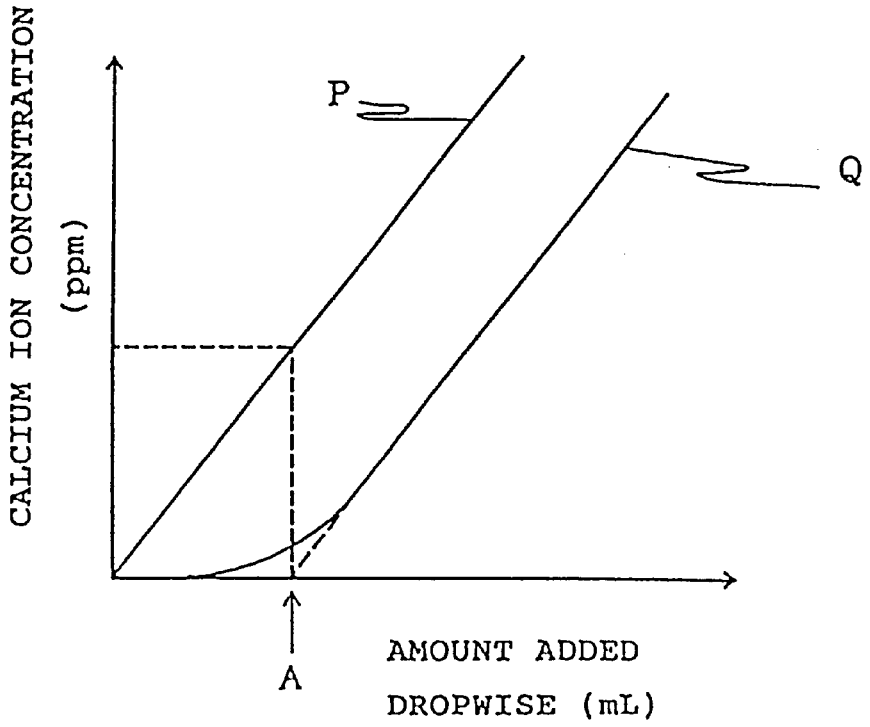
FIG. 2 is a graph showing the relationships between the amount of the $CaCl_2$ aqueous solution added dropwise and the calcium ion concentration.

The reference numerals in FIG. 2 are as follows:

A is an intersection of the extension of the linear portion of Line Q with the abscissa (horizontal axis); P shows the data of the blank solution (buffer solution without using the chelating agent); and Q shows the data for the chelating agent-containing buffer solution.

BEST MODE FOR CARRYING OUT THE INVENTION

In order to achieve an excellent washing power, the washing liquid having a high pH and low water hardness needs to be produced. Specifically, the washing liquid has to satisfy the following conditions.

(i) Containing metal ion capturing agents in amounts that the detergency is not affected by the water hardness of the fatty acid in the dirt stains.

(ii) Containing an alkalizing agent capable of buffering at suitably high pH.

From the aspect of having a high pH, the alkali metal silicates are preferred. Here, sodium silicates such as JIS No. 1 and JIS No. 2 usually used in detergents do not show metal ion capturing ability, while the crystalline alkali metal silicates are more preferred from the aspect of simultaneously satisfying both conditions (i) and (ii). However, there are some care needed even in cases where the crystalline alkali metal silicates are employed. This is because the alkalizing ability increases as the amount of the crystalline alkali metal silicate increases owing to its low water hardness. In such a case, it may inevitably result in an undesirable increase in the exchanging speeds of Ca and Mg ions with the alkali metal ions of the fatty acid salts. Therefore, in order to satisfy more preferred conditions, it is preferred that other metal ion capturing agents may be formulated in a particular proportion, within which range the standard amount of dosage of the detergents can be effectively reduced without impairing its detergency.

Therefore, as the high-density granular detergent composition of the present invention, there can be included a granular detergent composition having a bulk density of from 0.7 to 1.2 g/cm$^3$, comprising:

(A) one or more non-soap anionic surfactants;

(B) one or more crystalline alkali metal silicates; and (C) one or more metal ion capturing agents other than Component (B), wherein Component (A) is added in an amount of from 10 to 50% by weight, and a total amount of Component (B) and Component (C) is from 30 to 80% by weight, wherein a weight ratio of Component (B) to Component (C) is (B)/(C)=1/15 to 5/1, and wherein at least a part of said (B) crystalline alkali metal silicate is blended in builder granules, the builder granules comprising said crystalline alkali metal silicate, a binder and optionally an aluminosilicate, and wherein (A) the non-soap anionic surfactant is contained in the builder granules in an amount of less than 10% by weight. By using the above detergent composition, the amount of dosage can be reduced without impairing detergency.

In addition, in order to obtain effective detergency against composite dirt stains, (A) the non-soap anionic surfactants are blended in an amount of from 10 to 50% by weight, preferably from 20 to 50% by weight, more preferably from 20 to 40% by weight, in the entire detergent composition. In addition, the weight ratio of Component (B) the crystalline alkali metal silicates to Component (C) the metal ion capturing agents other than Component (B) in the detergent composition is (B)/(C)=1/15 to 5/1, wherein a total amount of Component (B) and Component (C) in the entire detergent composition is from 30 to 80% by weight, preferably from 40 to 70% by weight. The amounts of (A) the non-soap anionic surfactants, (B) the crystalline alkali metal silicates, and (C) the metal ion capturing agents other than the crystalline alkali metal silicates are most effective at the above given ranges. Also, the weight ratio of Component (B) to Component (C) is an essential feature in sufficiently exhibiting the effects of the present invention.

The preferred weight ratio of Component (B) to Component (C) is (B)/(C)=1/15 to 3/1, and still more preferred weight ratios may differ depending upon the initial water hardness of the washing liquid used. The water hardness of tap water greatly varies in different countries and geographical circumstances throughout the world. For instance, while the tap water used for washing has a water hardness of usually around 4° DH in Japan, the tap water has as high a water hardness of 6° DH or more in the U.S., and that exceeding 10° DH in European countries. In the present invention, still more preferred ranges for the weight ratios are as follows. In the case where the water hardness is from 2 to 6° DH, the weight ratio of Component (B) to Component (C) is (B)/(C)=3/7 to 3/1; in the case where the water hardness is from 6 to 10° DH, the weight ratio is (B)/(C)=1/6 to 4/3; and in the case where the water hardness is from 10 to 20° DH, the weight ratio is (B)/(C)=1/15 to 1/1.

In the present invention, in addition to the above blending conditions, the following conditions must be satisfied.

Specifically, at least a part, preferably 80% by weight or more of the entire crystalline alkali metal silicate, more preferably a whole part, of the crystalline alkali metal silicate is granulated using a binder, and the resulting granules are formulated in the detergent composition as the builder granules. Also, the non-soap anionic surfactant is contained in an amount of less than 10% by weight, preferably less than 5% by weight, in the builder granules. In the granular detergent composition of the present invention, the crystalline alkali metal silicate is substantially non-existent in the granule containing the non-soap anionic surfactant, sufficient detergency can be exhibited even after a long-term storage. The builder granules substantially comprise a crystalline alkali metal silicate, a binder for granulating the crystalline alkali metal silicate, and optionally a crystalline and/or amorphous aluminosilicate, such as zeolites. Besides the above ingredients, other ingredients can be optionally blended to the builder granules, such ingredients including fluorescent dyes, perfumes, commercially available oil-absorbing carriers, such as silica compounds (for instance, "TIXOLEX" (manufactured by Kofran Chemicals) and "TOKUSIL" (manufactured by Tokuyama Soda Co, Ltd.).

Builder granules prepared by granulating a crystalline layered sodium silicate, which is a crystalline alkali metal silicate, and/or a zeolite with a binder and detergents formulating such builder granules have been known, as disclosed, for instance, in Japanese Patent Unexamined Publication No. 6-502445, of which the disclosure is incorporated herein by reference. In this publication, however, a non-soap anionic surfactant is used as a binder, and in Examples of the publication, the non-soap anionic surfactant is contained in the builder granules in an amount higher than that required, the builder granules containing the crystalline layered sodium silicate. Here, the problem of the contact state of the non-soap anionic surfactant and the crystalline alkali metal silicate, as taught in the present invention, has never been suggested. Moreover, the compositional requirement for reducing the amount of dosage of detergents is never suggested.

The binders usable in the builder granules are preferably non-water-based binders, and the preferred examples thereof include polyethylene glycols having a weight-average molecular weight of from 3000 to 30000, nonionic surfactants exemplified below, and salts of fatty acids. Highly preferred examples of the nonionic surfactants include polyoxyethylene alkyl ethers which are ethylene oxide adducts of alcohols, of which the alkyl moiety has 10 to 20 carbon atoms, wherein ethylene oxide is added, in average, 4 to 10 moles. In a case where the amount of the crystalline alkali metal silicate contained in the builder granules in an amount exceeding 20% by weight of the builder granules, the salts of fatty acids may be added in the form of fatty acids during granulation, whereby the fatty acids are subjected to neutralization in a solid state with the crystalline alkali metal silicate to form salts of the fatty acids. Most preferably, the fatty acids and/or salts thereof are used in combination with the nonionic surfactants, in which case the builder granules have excellent powder properties and solubility. Besides Japanese Patent Unexamined Publication No. 6-502445 mentioned above, the builder granules may be prepared by referring to methods disclosed in Japanese Patent Laid-Open Nos. 6-10000 and 5-209200, DE19529298, and W095/26394, each of which the disclosure is incorporated herein by reference. It is preferred that the resulting builder granules are coated by such surface coating agents as aluminosilicates.

Suitable compositional ranges for the builder granules are as follows (weight % being proportion in the builder granules):

| | |
|---|---|
| Crystalline Alkali Metal Silicate | 10 to 80% by weight |
| Binder | 10 to 40% by weight |
| Aluminosilicate (calculated as anhydride) | 0 to 40% by weight |

It is preferred that the binder is one or more members selected from the group consisting of nonionic surfactants, fatty acids, salts of fatty acids, and polyethylene glycols. More preferably, the binder is one or more members selected from the group consisting of polyoxyethylene alkyl ethers, fatty acids, salts of fatty acids, and polyethylene glycols. The binders may be blended in a weight ratio of polyoxyethylene alkyl ethers: salts of fatty acids (may be added in the form of fatty acids): polyethylene glycols of from 10:1:0 to 10:30:100.

It is preferred that the binder is added in a liquid state after heating by spraying or adding dropwise to the powdery components. Also, a plurality of binders may be used in combination. For instance, a mixture comprising two or more members-selected from nonionic surfactants, polyethylene glycols, fatty acids, and salts of fatty acids may be used. Particularly in the present invention, highly stable builder granules can be preferably prepared by adding to the crystalline alkali metal silicate the binders comprising polyoxyethylene alkyl ethers and fatty acids and optionally polyethylene glycols. This is because the neutralization reaction between the crystalline alkali metal silicate and the fatty acid takes place at the surface of the crystalline alkali metal silicate, and the formed gel-like neutralized products, together with other binder components, coat the surface.

The builder granules have an average particle size of preferably from 250 to 1000 $\mu$m, more preferably from 350 to 600 $\mu$m. Also, the crystalline alkali metal silicate has an average particle size of preferably from 1 to 50 $\mu$m, more preferably from 5 to 35 $\mu$m. The particle sizes of the builder granules and the crystalline alkali metal silicate in the above ranges are particular suitable from the aspect of obtaining good detergency even with a small amount of dosage and also from the aspect of good powder properties and solubility provided thereby. The crystalline alkali metal silicate may be prepared to have the above average particle sizes and particle size distribution by pulverizing the crystalline alkali metal silicate with such means as pulverizing mills, such as vibration mills, hammer mills, ball mills, and roller mills.

Since the required absolute amount of the metal ion capturing agents varies as the water hardness varies in different countries and geographical circumstances as mentioned above, the standard detergent concentration would be optimally adjusted accordingly.

Therefore, in cases where the initial water hardness differs in each of the washing liquids, the detergent concentrations are as follows:

1) As for the water for washing having a water hardness of 2 to 6° DH, the detergent composition has a concentration in the washing liquid of from preferably 0.33 to 0.67 g/L, more preferably from 0.33 to 0.50 g/L.
2) As for the water for washing having a water hardness of 6 to 10° DH, the detergent composition has a concentration in the washing liquid of from preferably 0.50 to 1.20 g/L, more preferably from 0.50 to 1.00 g/L.
3) As for the water for washing having a water hardness of 10 to 20° DH, the detergent composition has a concentration in the washing liquid of from preferably 0.80 to 2.50 g/L, more preferably from 1.00 to 2.00 g/L.

Under these conditions, detergency equivalent or superior to that of the conventional detergents can be achieved in the high-density granular detergent composition for clothes washing of the present invention. Also, the DH water hardness is easily measured by an ion coupling plasma method (ICP method).

Incidentally, excessively high pH is likely to be easily affected by the water hardness, it is preferred that a maximum pH at 25° C. of the washing liquid when adding the amount satisfying the above standard detergent concentration conditions is not exceeding 11.5, preferably from 10.5 to 11.2, more preferably from 10.7 to 11.0.

Here, the term "maximum pH of the washing liquid" in the present invention means the maximum pH value of the washing liquid obtained by adding a given detergent composition to distilled water at 25° C. under conditions that washing items are absent in the detergent solution. Specifically, the maximum pH is measured as follows. A given amount of the granular detergent composition is added and stirred in one liter of distilled water at 25° C., and the pH of the solution is measured using such devices as a conventional glass electrode pH meter.

Each of the components will be explained in detail below.

(A) Non-Soap Anionic Surfactants

The non-soap anionic surfactants usable in the present invention refer to anionic surfactants other than salts of fatty acids, and any of those usually used in detergents may be used. The non-soap anionic surfactants may be one or more members selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates. Specific examples thereof include linear alkylbenzenesulfonates, of which an alkyl moiety has an average number of carbon atoms of 12 to 18; α-sulfofatty acid salts or methyl ester salts thereof, each of which alkyl moiety has an average number of carbon atoms of 14 to 18; α-olefinsulfonates, of which an alkyl moiety has an average number of carbon atoms of 12 to 18; alkyl sulfates or alkenyl sulfates, of which an alkyl moiety or alkylene moiety has an average number of carbon atoms of 12 to 22; and polyoxyethylene alkyl ether sulfates, of which ethylene oxide moiety has an average number of moles of 1 to 4. The alkali metal ions are most suitably used as counter ions of these salts from the aspect of detergency.

(B) Crystalline Alkali Metal Silicates

The alkali metal silicate usable in the present invention preferably has such an alkalizing ability, to a level that its maximum pH value is 11 or more at 25° C. in a 0.1% by weight dispersion, and that it takes 5 ml or more of a 0.1 N HCl aqueous solution to lower its pH to 10 for one liter of the above dispersion. Here, the alkali metal silicates are capable of giving good ion exchange capacity as well as alkalizing ability by making the alkali metal silicates crystalline, so that the standard amount of dosage of the detergent composition can be even further reduced. At least a part of Component (B) is formulated in the builder granules, and it is more preferred that the entire Component (B) is formulated in the builder granules.

The crystalline alkali metal silicates usable in the present invention preferably have $SiO_2/M_2O$ molar ratios of from 0.5 to 2.6, wherein M stands for an alkali metal atom. Also, the preferred ranges of the $SiO_2/M_2O$ molar ratios are 1.5 to 2.2. The above molar ratio is preferably 0.5 or more from the aspect of obtaining good ion exchange capacity and hygroscopic property, and the molar ratio is preferably 2.6 or less from the aspect of obtaining good alkalizing ability. Incidentally, the crystalline alkali metal silicates used in patent publications discussed in BACKGROUND ART section of the present invention have $SiO_2/Na_2O$ molar ratios (S/N ratio) of from 1.9 to 4.0. However, in the present invention, when the crystalline alkali metal silicates having the S/N ratios exceeding 2.6 cannot have the effects achieved by the present invention, thereby making it impossible to produce detergents having washing power with a remarkable reduction in the standard amount of dosage.

Among the crystalline alkali metal silicates usable in the present invention, a preference is given to those having the following compositions:

$$(1)\ xM_2O \cdot ySiO_2 \cdot zMe_mO_n \cdot wH_2O, \qquad (1)$$

wherein M stands for an element in Group Ia of the Periodic Table; Me stands for one or more members selected from the group consisting of elements of Groups IIa, IIb, IIIa, IVa, and VIII of the Periodic Table; y/x is from 0.5 to 2.6; z/x is from 0.01 to 1.0; n/m is from 0.5 to 2.0; and w is from 0 to 20.

$$(2)\ M_2O \cdot x'SiO_2 \cdot y'H_2O, \qquad (2)$$

wherein M stands for an alkali metal atom; x' is from 1.5 to 2.6; and y' is from 0 to 20.

First, the crystalline alkali metal silicates having the composition (1) above will be detailed below.

In the general formula (1), M stands for an element selected from Group Ia of the Periodic Table, wherein the Group Ia elements may be exemplified by Na, K, etc. The Group Ia elements may be used alone, or in combination of two or more kinds. For instance, such compounds as $Na_2O$ and $K_2O$ may be mixed to constitute an $M_2O$ component.

Me stands for one or more members selected from the group consisting of elements of Group IIa, IIb, IIIa, IVa, and VIII of the Periodic Table, and examples thereof include Mg, Ca, Zn, Y, Ti, Zr, and Fe, which are not particularly limited to the above examples. Here, a preference is given to Mg and Ca from the viewpoint of resource stock and safety. In addition, these elements may be used alone, or in combination of two or more kinds. For instance, such compounds as MgO and CaO may be mixed to constitute an $Me_mO_n$ component.

In addition, the crystalline alkali metal silicates in the present invention may be in the form of hydrates, wherein the amount of hydration (w) is usually in the range of from 0 to 20 moles of $H_2O$.

With respect to the general formula (1), y/x is preferably from 0.5 to 2.6, more preferably from 1.5 to 2.2. From the aspect of anti-solubility in water, y/x is preferably 0.5 or more. When the anti-solubility in water is insufficient, powder properties of the detergent composition, such as caking properties, solubility, etc. are likely to be drastically lowered. From the aspect of sufficiently functioning as alkalizing agent and ion exchange materials, y/x is preferably 2.6 or less.

With respect to z/x, it is preferably from 0.01 to 1.0, more preferably from 0.02 to 0.9, particularly preferably from 0.02 to 0.5. From the aspect of the anti-solubility in water, z/x is preferably 0.01 or more, and from the aspect of sufficiently functioning as ion exchange materials, z/x is preferably 1.0 or less.

With respect to x, y and z, there are no limitations, as long as y/x and z/x have the above relationships. When $xM_2O$, for example, is $x'Na_2O \bullet x''K_2O$ as described above, x equals to x' +x". The same can be said for z when $zMe_mO_n$ comprises two or more components. Further, "n/m is from 0.5 to 2.0" indicates the number of oxygen ions coordinated to the above elements, which actually takes values selected from 0.5, 1.0, 1.5, and 2.0.

The crystalline alkali metal silicate having the composition (1) consists of three components, $M_2O$, $SiO_2$, and $Me_mO_n$. Materials which can be converted to each of these components, therefore, are indispensable for starting materials for producing the crystalline alkali metal silicates in the present invention. Here, known compounds can be suitably used for starting materials for the crystalline alkali metal silicates without limitations in the present invention. Examples of the $M_2O$ component and the $Me_mO_n$ component include simple or complex oxides, hydroxides and salts of respective elements; and minerals containing respective elements. Specifically, examples of the starting materials for the $M_2O$ component include NaOH, KOH, $Na_2CO_3$, $K_2CO_3$, and $Na_2SO_4$. Examples of the starting materials for the $Me_mO_n$ component include $CaCO_3$, $MgCO_3$, $Ca(OH)_2$, $Mg(OH)_2$, MgO, $ZrO_2$, and dolomite. Examples of the starting materials for the $SiO_2$ component include silica sand, kaolin, talc, fused silica, and sodium silicate.

The method of producing the crystalline alkali metal silicate having the composition (1) may be exemplified by blending these starting material components to provide a desired composition in x, y, and z for the crystalline alkali metal silicate, and baking the resulting mixture at a temperature in the range of preferably from 300 to 1500° C., more preferably from 500 to 1000° C., still more preferably from 600 to 900° C., to form crystals. In this case, the heating temperature is preferably 300° C. or more in order to sufficiently complete the crystallization, which in turn makes it possible to maintain good anti-solubility in water of the resulting crystalline alkali metal silicate. The heating temperature is preferably 1500° C. or less in order to prevent the formation of coarse grains which in turn makes it possible to maintain good ion exchange capacity of the resulting crystalline alkali metal silicate. The heating time is preferably 0.1 to 24 hours. Such baking can be preferably carried out in a heating furnace such as an electric furnace or a gas furnace.

Next, the crystalline alkali metal silicates having the composition (2) above will be detailed below.

These crystalline alkali metal silicates are represented by the general formula (2):

$$M_2O \bullet x'SiO_2 \bullet y'H_2O, \quad (2)$$

wherein M stands for an alkali metal atom; x' is from 1.5 to 2.6; and y' is from 0 to 20.

Among them, a preference is given to the crystalline alkali metal silicates having x' and y' in the general formula (2) such that each satisfies $1.7 \leqq x' \leqq 2.2$ and $y'=0$, and those having a cationic exchange capacity of preferably 100 $CaCO_3$ mg/g or more, more preferably from 200 to 400 $CaCO_3$ mg/g, are usable. The above crystalline alkali metal silicates are one of the materials having ion capturing ability in the present invention.

Since the crystalline alkali metal silicate in the present invention has not only good alkalizing ability and alkaline buffering capacity but also good ion exchange capacity, the washing conditions are suitably adjusted by formulating suitable amounts of the crystalline alkali metal silicate.

A method for producing the above crystalline alkali metal silicates is disclosed in Japanese Patent Laid-Open No. 60-227895, of which the disclosure is incorporated herein by reference. However, the crystalline alkali metal silicates may be generally produced by baking glassy amorphous sodium silicate at a temperature of from 200 to 1000° C. Details of the production method is disclosed in "Phys. Chem. Glasses, 7, 127–138 (1966), Z. Kristallogr., 129, 396–404(1969)," of which the disclosure is incorporated herein by reference. Also, the crystalline alkali metal silicates are commercially available in powdery or granular forms under a trade name "Na-SKS-6" ($\delta$-$Na_2Si_2O_5$) (manufactured by Hoechst). Also, Japanese Patent Laid-Open No. 7-187655, of which the disclosures are incorporated herein by reference, discloses a crystalline alkali metal silicate containing not only sodium but also a particular amount of potassium.

The crystalline alkali metal silicate constituting Component (B) in the present invention has good alkalizing ability and alkaline buffering capacity as described above. In this aspect, the alkali metal silicates are easily distinguished from the aluminosilicates, such as zeolites, in the present invention. Also, when compared to sodium carbonate and potassium carbonate, the alkali metal silicates have superior function as alkalizing agents.

The crystalline alkali metal silicate in the present invention preferably has an ion exchange capacity of 100 $CaCO_3$ mg/g or more, more preferably from 200 to 600 $CaCO_3$ mg/g. It is preferred that the amount of Si dissolved in water when stirred at 25° C. for 30 minutes is preferably less than 110 mg/g, when calculated as $SiO_2$, particularly 100 mg/g or less, from the aspect of obtaining good detergency in the present invention.

In the present invention, the crystalline alkali metal silicate having the general formula (1) and the crystalline alkali metal silicate having the general formula (2) may be used alone or in combination. It is preferred that the total amount of the crystalline alkali metal silicates is 50 to 100% by weight, more preferably 70 to 100% by weight, of the entire content of the alkalizing agents in the detergent composition, the alkalizing agents comprising crystalline alkali metal silicates usable in the present invention and other alkalizers, such as alkali metal carbonates. From the aspect of aggressively accelerating its self emulsification effects of the sebum dirt stains, the amount of the crystalline alkali metal silicate is preferably 50% by weight or more.

In the present invention, as a silicate ingredient other than the crystalline alkali metal silicates, amorphous alkali metal silicates, such as sodium silicates JIS No. 1, 2, and 3 may be used for backbone-constituting ingredients of the spray-dried granules. However, in order to have an even lower standard amount of dosage per cycle, the amorphous alkali metal silicate may be actually contained in an amount of preferably 10% by weight or less, more preferably from 1 to 7% by weight.

(C) Metal Ion Capturing Agents Other Than Component (B). Crystalline Alkali Metal Silicates The metal ion capturing agents other than the crystalline alkali metal silicates in the present invention have a calcium ion capturing capacity of 200 $CaCO_3$ mg/g or more, more preferably 300 $CaCO_3$ mg/g or more. In the present invention, carboxylic acid polymers and aluminosilicate, such as zeolites, may be suitably used.

Examples of the polymers having ion capturing ability include polymers or copolymers, each having repeating units represented by the general formula (3):

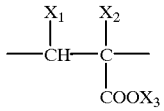

(3)

wherein $X_1$ stands for a methyl group, a hydrogen atom, or a $COOX_3$ group; $X_2$ stands for a methyl group, a hydrogen atom, or a hydroxyl group; $X_3$ stands for a hydrogen atom, an alkali metal ion, an alkaline earth metal ion, an ammonium ion, or 2-hydroxyethylammonium ion.

In the general formula (3), examples of the alkali metal ions include Na, K, and Li ions, and examples of the alkaline earth metal ions include Ca and Mg ions.

Examples of the polymers or copolymers usable in the present invention include those obtainable by polymerization reactions of acrylic acid, (anhydrous) maleic acid, methacrylic acid, α-hydroxyacrylic acid, crotonic acid, isocrotonic acid, and salts thereof; copolymerization reactions of each of the monomers; or copolymerization reactions of the above monomers with other copolymerizable monomers. Here, examples of the other polymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic ester, without particularly being limited thereto. Incidentally, the polymerization reaction is not particularly limited, and, any of conventional methods can be employed.

Also, polyacetal carboxylic acid polymers such as polyglyoxylic acids disclosed in Japanese Patent Laid-Open No. 54-52196, of which the disclosure is incorporated herein by reference, are also usable for the polymers in the present invention.

In the present invention, the above polymers and copolymers preferably have a weight-average molecular weight of from 800 to 1,000,000, more preferably from 5,000 to 200,000.

Also, in the case of copolymers, although the copolymerization ratios between the repeating units of the general formula (3) and other copolymerizable monomers are not particularly limited, a preference is given to copolymerization ratios of the repeating units of general formula (3)/other copolymerizable monomer=1/100 to 90/10.

In the present invention, the above polymer or copolymer is contained in the entire composition in an amount of preferably from 1 to 50% by weight, more preferably from 2 to 30% by weight, particularly from 5 to 15% by weight.

In addition, a highly preferred example of (C) the metal ion capturing agents comprise: (C-i) the carboxylate, polymer mentioned above having a Ca ion capturing capacity of 200 $CaCO_3$ mg/g or more; and (C-ii) an aluminosilicate having an ion exchange capacity of 200 $CaCO_3$ mg/g or more and having the following formula (4):

$$x''(M_2O)\cdot Al_2O_3\cdot y''(SiO_2)\cdot w''(H_2O), \quad (4)$$

wherein M stands for an alkali metal atom, such as sodium or potassium; x", y", and w" each stands for a molar At number of each component; and generally, x" is from 0.7 to 1.5; y" is from 0.8 to 6; and w" is from 0 to 20, wherein the weight ratio of Component (C-i) to Component (C-ii) is (C-i)/(C-ii)=1/20 to 4/1, preferably 1/9 to 4/1. The total amount of Components (C-i) and (C-ii) Components preferably occupies 70 to 100% by weight based on (C) the metal ion capturing agent.

The aluminosilicates mentioned above may be crystalline or amorphous, and among the crystalline aluminosilicates, a particular preference is given to those having the following general formula:

$$Na_2O\cdot Al_2O_3\cdot ySiO_2\cdot wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 μm, which are typically exemplified by A-type zeolite, X-type zeolite, and P-type zeolite, are suitably used. The zeolites may be used in the forms of powder, a zeolite slurry, or dried particles comprising zeolite agglomerates obtained by drying the slurry. The zeolites of the above forms may also be used in combination.

The above crystalline aluminosilicates are obtainable by conventional methods. For instance, methods disclosed in Japanese Patent Laid-Open Nos. 50-12381 and 51-12805 may be employed, each of which the disclosure is incorporated herein by reference.

On the other hand, the amorphous aluminosilicates represented by the same general formula as the above crystalline aluminosilicate are also obtainable by conventional methods. For instance, the amorphous aluminosilicates are prepared by adding an aqueous solution of a low-alkaline metal aluminate having a molar ratio of $M_2O$ to $Al_2O_3$ (M standing for an alkali metal atom) of $M_2O/Al_2O_3$=1.0 to 2.0 and a molar ratio of $H_2O$ to $M_2O$ of $H_2O/M_2O$=6.0 to 500 to an aqueous solution of an alkali metal silicate having a molar ratio of $SiO_2$ to $M_2O$ of $SiO_2/M_2O$=1.0 to 4.0 and a molar ratio of $H_2O$ to $M_2O$ of $H_2O/M_2O$=12 to 200 under vigorous stirring at preferably 15 to 60° C., more preferably 30 to 50° C.

The intended product may be advantageously obtained by heat-treating a white slurry of precipitates thus formed at preferably 70 to 100° C., more preferably 90 to 100° C., for preferably 10 minutes or more and 10 hours or less, more preferably 5 hours or less, followed by filtration, washing and drying. Incidentally, the aqueous solution of an alkali metal silicate may be added to the aqueous solution of a low-alkaline alkali metal aluminate.

By this method, the oil-absorbing amorphous aluminosilicate carrier having an ion exchange capacity of 100 $CaCO_3$ mg/g or more and an oil-absorbing capacity of 80 ml/100 g or more can be easily obtained. See Japanese Patent Laid-Open Nos. 62-191417 and 62-191419, each of which the disclosure is incorporated herein by reference.

Beside the ones mentioned above, examples of the metal ion capturing agents constituting Component (C) include aminotri(methylenephosphonic acid), 1-hydroxyethylidene-1,1-diphosphonic acid, ethylenediaminetetra (methylenephosphonic acid), diethylenetriaminepenta (methylenephosphonic acid), and salts thereof; salts of phosphonocarboxylic acids, such as salts of 2-phosphonobutane-1,2-dicarboxylic acid; amino acid salts, such as aspartates and glutamates; aminopolyacetates, such as nitrilotriacetates and ethylenediaminetetraacetates.

In a case where Component (C) is formulated in the builder granules, Component (C) in the form of the powdery materials may be formulated by blending it with the crystalline alkali metal silicate, wherein aluminosilicates may be optionally used as coating agents for the builder granules. Besides the above, Component (C) may be formulated in the form of spray-dried granules prepared by adding inorganic substances, such as aluminosilicates and sodium sulfate and carbonates, and organic substances of Component (C), such as the polymer represented by the general formula (3), to give a slurry mixture, and spray-drying the resulting slurry mixture. As a matter of course, Component (C) may be present in the granules other than the builder granules.

Components (B) and (C) are substances having metal ion capturing ability. Here, the methods for measuring the ion capturing capability of the metal ion capturing materials depend upon whether the ion exchange materials or the chelating agents are used for the metal ion capturing materials. The measurement methods for each of the materials in the present invention are given below.

Ion Exchange Material

The amount 0.1 g of an ion exchange material is accurately weighed and added to 100 ml of a calcium chloride aqueous solution (500 ppm concentration, when calculated as $CaCO_3$), followed by stirring at 25° C. for 60 minutes. Thereafter, the mixture is filtered using a membrane filter (made of nitrocellulose; manufactured by Advantech) with 0.2 $\mu$m pore size. The amount 10 ml of the filtrate is assayed for Ca content by an EDTA titration, and the calcium ion exchange capacity (cationic exchange capacity) of the ion exchange material is calculated from the titer.

For instance, in the present invention, inorganic substances, such as the crystalline alkali metal silicates and the aluminosilicates, such as zeolites, are measured as ion exchange materials.

Chelating Agent

The calcium ion capturing capacity of the chelating agent is measured by the following method using a calcium ion electrode. Incidentally, the solution used herein is prepared with the following buffer solution:

Buffer: 0.1 M—$NH_4Cl$—$NH_4OH$ buffer (pH 10.0)

(i) Preparation of Calibration Curve

Figure 1:
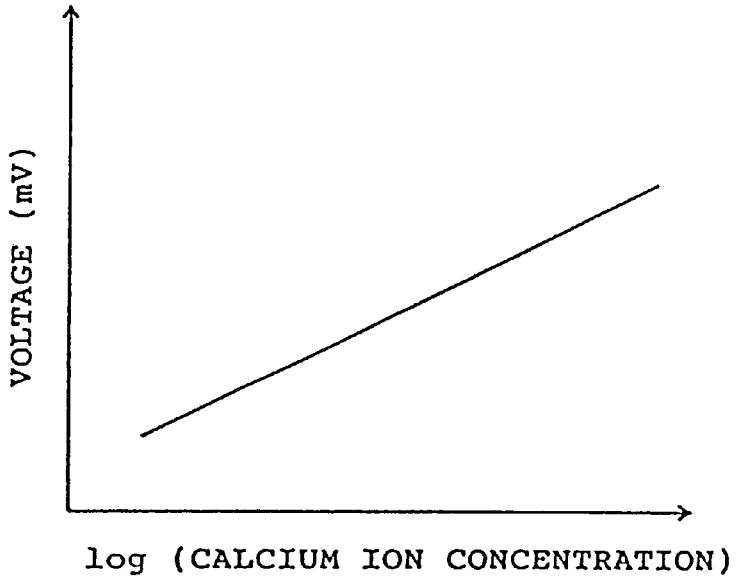
FIG. 1 is a graph of a calibration curve showing the relationship between the logarithm of the calcium ion concentration and the voltage.

A standard calcium ion solution is prepared and voltage readings are taken to prepare a calibration curve showing the relationships between the logarithm of the calcium ion concentration and the voltage, as shown in FIG. 1.

(ii) Measurement of Calcium Ion Capturing Capacity

About 0.1 g of a chelating agent is weighed, and a 100 ml volumetric flask is charged with the chelating agent. The volumetric flask is filled up to a volume of 100 ml with the above buffer solution. A $CaCl_2$ aqueous solution (pH 10.0) having a calcium ion concentration of 20,000 ppm calculated as $CaCO_3$ is added dropwise from a burette. The dropwise addition is made in an amount of 0.1 to 0.2 ml for each voltage reading. In addition, the buffer solution without containing the chelating agent is also subjected to the same dropwise treatment of the $CaCl_2$ aqueous solution. This solution is called a "blank solution." Thus, a calcium ion concentration is calculated from the calibration curve given in FIG. 1 by taking a voltage reading. The relationship between the amount of the $CaCl_2$aqueous solution added dropwise and the calcium ion concentration is shown in a graph (FIG. 2). In FIG. 2, Line P shows the data of the blank solution (buffer solution without using the chelating agent), and Line Q shows the data for the chelating agent-containing buffer solution. The point where the extension of the linear portion of Line Q intersects with the abscissa (horizontal axis) is called "A." The calcium ion capturing capacity of the chelating agent is obtained from the calcium ion concentration at "A" of the blank solution.

For instance, in the present invention, the polycarboxylates, such as citrates, and carboxylate polymers, such as acrylic acid-maleic acid copolymers are measured as chelating agents.

The high-density, granular detergent composition of the present invention comprises Components (A), (B), and (C) in particular proportions, wherein at least a part or a whole part of the crystalline alkali metal silicate constituting Component (B) is contained in the builder granules, and wherein the builder granules contain the non-soap anionic surfactant in an amount of less than 10% by weight. In such high-density detergents, other ingredients may be optionally formulated.

One of the other ingredients which may be formulated in the granular detergent composition of the present invention include nonionic surfactants. The nonionic surfactants are usable as binders for the builder granules, and they may be formulated in granules other than the builder granules.

The nonionic surfactants are not particularly limited, and any of conventionally known ones may be used. Examples thereof include the following.

Polyoxyalkylene alkyl ethers, such as polyoxyethylene alkyl ethers and polyoxypropylene alkyl ethers, polyoxyethylene alkylphenyl ethers, polyoxyethylene sorbitan fatty acid esters, polyoxyethylene sorbitol fatty acid esters, polyoxyethylene fatty acid esters, polyoxyethylene fatty acid alkyl esters, polyoxyethylene polyoxypropylene alkyl ethers, polyoxyethylene castor oils, polyoxyethylene alkylamines, glycerol fatty acid esters, higher fatty acid alkanolamides, alkylglycosides, alkylglucosamides, and alkylamine oxides.

Among these nonionic surfactants, a preference is given to polyoxyalkylene alkyl ethers, and greater preference is given to alkylene oxide adducts of alcohols, whose alkyl moiety has an average number of carbon atoms of 10 to 18. The alcohols used herein may be preferably primary or secondary alcohols, whose alkyl moiety may be linear or branched. Examples of the alkylene oxides include ethylene oxide and propylene oxide. The alkylene oxides may be added in average, preferably from 4 to 10 moles.

The propylene oxide adducts preferably may be those added with 1 to 4 moles of propylene oxide to a compound in which ethylene oxide is previously added in an average of 1 to 10 moles. The ethylene oxide adducts may include polyoxyethylene alkyl ethers, of which ethylene oxide moiety has an average additional molar number of 10 or less.

More preferably, polyoxyethylene alkyl ethers which are ethylene oxide adducts of linear or branched, primary or secondary alcohols, of which alkyl moiety has 12 to 14 carbon atoms and ethylene oxide is added, in average, 3 to 9 moles, more preferably 4 to 6.5 moles, particularly preferably 4 to 6 moles. The nonionic surfactants may be included in the detergent composition, at most 20% by weight, including the portion included in the builder granules.

Also, other surfactants such as fatty acids derived from beef tallow, palm oil, or coconut oil, and/or alkali metal salts of these fatty acids may be blended. When such surfactants are blended, they may be formulated in an amount of preferably 12% by weight or less, more preferably from 0.5 to 8% by weight in the detergent composition of the present invention. Besides them, cationic surfactants, including quaternary ammonium salts, such as alkyl trimethyl amine salts, and tertiary amines, and carboxy-type or sulfobetaine-type amphoteric surfactants, which are conventionally formulated in detergents, may be added in amounts so as not to impair the effects of the present invention.

In the present invention, in a case where the nonionic surfactants, most preferably the polyoxyethylene alkyl ethers mentioned above, are combinably used with other surfactant components in an amount of 5% by weight or more in the entire detergent composition, a further improvement in detergency can be achieved by satisfying the compositional weight ratio mentioned below. In other words, the most preferred detergent composition is such that the weight ratio of the crystalline alkali metal silicate to the entire surfactants, excluding soaps, cationic surfactants and amphoteric surfactants, is preferably from 9/1 to 1/2, more preferably from 9/1 to 9/11.

Examples of other ingredients which may be added to the granular detergent composition of the present invention include various salts including alkali metal salts of chlorides, carbonates, and sulfites, and organic amines, such as alkanolamines, besides amorphous alkali metal silicates. In a case of making high the density of granular detergent composition by processing spray-dried particles, it is preferred that sodium sulfate is blended as the backbone substance in the detergent composition, and sodium sulfate is blended in an amount of preferably 8% by weight or less, more preferably from 0.5 to 6% by weight. Also, the amorphous sodium silicates and the carboxylate polymers mentioned above may be also blended as the backbone substances.

In addition, color-fading preventives and anti-redeposition agents generally blended in detergent compositions, including non-dissociating polymers such as polyvinyl alcohols, and polyvinyl pyrrolidones; organic acid salt builders, such as diglycolates and hydroxycarboxylates; and carboxymethyl cellulose may be optionally used.

Besides the above, the following ingredients may be also contained in the high-density, granular detergent composition of the present invention. For instance, caking preventives, such as lower alkylbenzenesulfonates whose alkyl moieties have about 1 to 4 carbon atoms, sulfosuccinates, talc, and calcium silicates; and antioxidants, such as tert-butylhydroxytoluene and distyrenated cresol, may be used together with stilbene-type and biphenyl-type fluorescent dyes as in conventional methods. Also, blueing agents may be added, and perfumes suitable for high-density detergents disclosed in Japanese Patent Laid-Open Nos. 63-101496 and 5-202387, each of which the disclosure is incorporated herein by reference, may be also added. The kinds and use of these optional ingredients are not particularly limited thereto. Besides them, enzymes, such as proteases, lipases, cellulases, and amylases; bleaching agents, such as sodium percarbonate; bleaching activators, such as tetraacetyl ethylenediamine may be dry-blended as separate granules in the granular detergent composition of the present invention. The optional ingredients are not particularly limited, and they may be blended so as to give desired compositions suitable for their purposes.

The granular detergent composition for washing clothes of the present invention has a bulk density of from 0.7 to 1.2 g/cm$^3$, preferably from 0.7 to 1.0 g/cm$^3$. Even if the dosage (weight) were the same, the higher the bulk density, the lower the volume per cycle. For this reason, the higher the bulk density, the better. However, some care is needed because too high a bulk density may cause to lower solubility. Here, when a total amount of Composition (A), Composition (B), and Composition (C) in the entire granular detergent composition is preferably from 70% by weight to 99% by weight, more preferably from 80% by weight to 99% by weight, the standard amount of dosage can be lowered remarkably. Studies have been made to prepare blending compositions taking into consideration the incorporation of perfume ingredients, fluorescent dyes, and enzyme granules, and optionally bleaching agents and bleaching activators in addition to Composition (A), Composition (B), and Composition (C).

Also, in the present invention, it is preferred that ingredients other than the builder granules, the enzyme granules, the bleaching agent granules, and the bleaching activator granules are contained in one granule. In particular, known high-density detergent granules comprising non-soap anionic surfactants, nonionic surfactants, zeolites, alkalizing agents, and backbone agents such as alkali metal carbonates and amorphous alkali metal silicates, and carboxylate polymers may be formulated in the detergent composition without treatments. These granules may be prepared employing presently known methods in accordance with the preparation conditions depending upon the compositions to be prepared. Examples of the methods for producing high-density detergents include the methods disclosed in Japanese Patent Laid-Open Nos. 61-69897, 61-69899, 61-69900, 5-209200, and DE19529298, of which the disclosures are incorporated herein by reference. In addition, a method for obtaining a detergent composition with an even higher density may be referred to W095/26394, of which the disclosure is incorporated herein by reference.

The present invention will be more specifically explained of the following working examples, without intending to restrict the scope of the present invention thereto.

The physical properties of products obtained in the working examples are measured by the following methods.

(1) Amount of Materials Having Ion Capturing Capacity

The ion capturing ability is measured by the following different methods in accordance with a case where the materials used having a metal ion capturing capacity are ion exchange materials and a case where the materials are chelating agents.

A metal ion capturing capacity and a calcium ion capturing capacity are measured by the methods described above. Incidentally, the ion capturing capacity of the metal ion capturing agents are expressed by CEC (calcium ion exchange capacity) as in the same manner as in alkali metal silicates. In addition, the DH water hardness is measured by ion-coupling plasma method (ICP method).

(2) Average Particle Size and Particle Size Distribution of Crystalline Alkali Metal Silicates The average particle size and the particle size distribution are measured by using a laser scattering particle size distribution analyzer. Specifically, about 200 ml of ethanol is poured into a measurement cell of a laser scattering particle size distribution analyzer ("LA-700," manufactured by HORIBA Ltd.), and about 0.5 to 5 mg of the crystalline alkali metal silicate is suspended in ethanol. Next, while subjecting the obtained ethanol suspension to ultrasonic wave irradiation, the mixture is agitated for one minute, to thereby sufficiently disperse the crystalline alkali metal silicate. Thereafter, the resulting mixture is subjected to an He-Ne laser beam (632.8 nm) irradiation to measure diffraction/scattering patterns. The particle size distribution is obtained from the diffraction/scattering patterns. The analysis is made based on the combined theories of Fraunhofer diffraction theory and Mie scattering theory. The particle size distribution of the suspended particles in the liquid is measured within the size range of from 0.04 to 262 $\mu$m. The average particle size is a median diameter of the particle size distribution.

Preparation Example 1 (Crystalline Alkali Metal Silicate A)

To 1000 parts by weight of No. 2 sodium silicate ($SiO_2$/$Na_2O$=2.5), 55.9 parts by weight of sodium hydroxide and 8.5 parts by weight of potassium hydroxide were added, followed by stirring using a homomixer to thereby dissolve sodium hydroxide and potassium hydroxide. To this solution, 5.23 parts by weight of finely dispersed anhydrous calcium carbonate and 0.13 parts by weight of magnesium nitrate hexahydrate were added, and the components were agitated by using a homomixer. A given amount of the mixture was transferred into a nickel crucible and baked in the air at a temperature of 700° C. for one hour, followed by rapid cooling. The resulting baked product was powdered, to give Crystalline Alkali Metal Silicate A in the present invention. This powder had an ion exchange capacity (CEC) as high as 305 $CaCO_3$ mg/g. Here, the average particle size of Crystalline Alkali Metal Silicate A was 22 μm. Also, the composition and CEC of the crystalline alkali metal silicate thus obtained were as follows:

$$xM_2O \cdot ySiO_2 \cdot zMe_mO_n \cdot wH_2O,$$

wherein $M_2O$: $Na_2O$, $K_2O$ [K/Na=0.03].
y/x: 1.8.
$Me_mO_n$: CaO, MgO [Mg/Ca=0.01].
z/x: 0.02.
CEC: 305 $CaCO_3$ mg/g.

Preparation Example 2 (Amorphous Aluminosilicate)

Sodium carbonate was dissolved in ion-exchanged water, to prepare an aqueous solution with 6% by weight concentration. 132 g of the above aqueous solution and 38.28 g of a sodium aluminate aqueous solution (conc. 50% by weight) were placed in a 1000-ml reaction vessel equipped with baffles. 201.4 g of a solution of No. 3 liquid glass diluted with twice the amount of water were added dropwise to the above mixed solution by under vigorous agitation at a temperature of 40° C. over a period of 20 minutes. Here, the reaction speed was optimized by adjusting the pH of the reaction system to 10.5 by blowing a $CO_2$ gas thereinto. Thereafter, the reaction system was heated up to a temperature of 50° C. and stirred at 500° C. for 30 minutes. Subsequently, an excess alkali was neutralized by blowing a $CO_2$ gas thereinto, and the pH of the reaction system was adjusted to 9.0. The obtained neutralized slurry was filtered under a reduced pressure using a filter paper (No. 5C, manufactured by Toyo Roshi Kaisha, Ltd.). The filtered cake was rinsed with water in an amount of 1000-folds that of the cake, and the rinsed cake was filtered and dried under the conditions of 105° C., 300 Torr, and 10 hours. Further, the dried cake was disintegrated, to give an amorphous aluminosilicate powder in the present invention. Incidentally, the sodium aluminate aqueous solution was prepared by the steps of adding and mixing 243 g of $Al(OH)_3$ and 298.7 g of a 48% by weight NaOH aqueous solution in a 1000 ml four-necked flask, heating the mixture to a temperature of 110° C. with stirring, and maintaining at that temperature for 30 minutes to dissolve the components.

From the results of atomic absorption spectrophotometry and plasma emission spectrochemical analysis, the resulting Amorphous Aluminosilicate had the following composition: $Al_2O_3$=29.6% by weight; $SiO_2$=52.4% by weight; and $Na_2O$=18.0% by weight (1.0 $Na_2O \cdot Al_2O_3 \cdot 3.10\ SiO_2$). In addition, the calcium ion capturing capacity (CEC) was 185 $CaCO_3$ mg/g, and the oil-absorbing capacity was 285 ml/100 g. The content of the microporous capacity having a microporous diameter of less than 0.1 μm was 9.4% by volume in the entire micropores, and the content of the microporous capacity having a microporous diameter of 0.1 μm or more and 2.0 μm or less was 76.3% by volume in the entire micropores. The water content was 11.2% by weight.

EXAMPLE 1

Preparation of Builder Granules (I)

3.0 parts by weight of a zeolite (4A-type; average particle size: 3 μm; CEC=280 $CaCO_3$ mg/g, manufactured by Tosoh Corporation), 1.0 part by weight of an acrylic acid-maleic acid copolymer (trade name: "SOKALAN CP-5," manufactured by BASF; weight-average molecular weight: 70,000; CEC=380 $CaCO_3$ mg/g), and 2.5 parts by weight of sodium sulfate were added to prepare an aqueous slurry of 50% by weight solid content. The resulting slurry was spray-dried using a counter-current flow spray drier, to give Spray-Dried Granules L with a water content of 5% by weight of the dead weight. Thereafter, 6.9 parts by weight of Spray-Dried Granules L, 15.0 parts by weight of Crystalline Alkali Metal Silicate A prepared in Preparation Example 1, 5.0 parts by weight of Amorphous Aluminosilicate prepared in Preparation Example 2, and 0.5 parts by weight of Fluorescent Dye S (trade name: "WHITEX SA," manufactured by Sumitomo Chemical Company Ltd.) were supplied in a Lödige Mixer (Matsuzaka Giken Co., Ltd., equipped with a jacket). The components were agitated while keeping the jacket temperature at 70° C. Subsequently, the above components were subjected to further granulation by blending in advance at 70° C. to prepare a mixture comprising 9.0 parts by weight of a polyoxyethylene alkyl ether (trade name: "NONIDET R-7," manufactured by Mitsubishi Chemical Corporation, an alkylene oxide adduct, of which the alkyl moiety has 12 to 15 carbon atoms, and the ethylene oxide moiety has a molar number of 7.2) and 4.5 parts by weight of palmitic acid (trade name: "LUNAC P-95," manufactured by Kao Corporation), and spraying the resulting mixture to the above components in the mixer. Here, a part or a whole part of the fatty acid was neutralized to form a salt of the fatty acid on the surface of Crystalline Alkali Metal Silicate A having a high alkalizing ability. Further, the resulting granules were surface-coated for improving the powder properties by adding 3.0 parts by weight of the zeolite (4A-type) to the surface. The builder granules (I) thus obtained had a bulk density of 0.85 g/cm$^3$ and an average particle size of 448 μm.

Preparation of Anionic Surfactant Granules (I)

0.6 parts by weight of a polyoxyethylene alkyl ether (trade name: "EMULGEN 108," manufactured by Kao Corporation, of which an ethylene oxide moiety has an average molar number of 6.0 and an alkyl moiety has 12 carbon atoms), 14.0 parts by weight of a sodium linear alkylbenzenesulfonate of which alkyl moiety has 12 carbon atoms, 4.0 parts by weight of a sodium alkyl sulfate of which alkyl moiety has 14 carbon atoms, 2.0 parts by weight of an acrylic acid-maleic acid copolymer (trade name: "SOKALAN CP-5," manufactured by BASF, weight-average molecular weight: 70,000, CEC=380 $CaCO_3$ mg/g), 10.0 parts by weight of a zeolite (4A-type, average particle size: 3 μm, CEC=280 $CaCO_3$ mg/g, manufactured by Tosoh Corporation), 0.4 parts by weight of a polyethylene glycol (manufactured by Nippon Shokubai Co., Ltd., weight-average molecular weight: 8,000), 5.0 parts by weight of sodium carbonate, 2.0 parts by weight of potassium carbonate, 4.0 parts by weight of JIS No. 1 Sodium Silicate, 4.0 parts by weight of sodium sulfate, 1.0 part by weight of sodium sulfite, and 0.1 parts by weight of Fluorescent Dye T (trade name: "CINOPEARL CBS-X," manufactured by Ciba Geigy AG) were added to prepare an aqueous slurry of 50% by weight solid content. The resulting slurry was spray-dried using a countercurrent flow spray drier, to give Spray-Dried Granules M with 6% by weight of water content of the dead weight. 50.1 parts by weight of Spray- Dried Granules M were then supplied in a High-Speed Mixer (manufactured by Fukae Powtec Corp.). While agitating at room temperature, the spray-dried granules were subjected to granulation by gradually spraying 0.5 parts by weight of the polyoxyethylene alkyl ether (trade name: "EMULGEN 108"), previously heated to 70° C., to the spray-dried granules. Further, the resulting granules were surface-coated for improving the powder properties by adding 3.0 parts by weight of the zeolite (4A-type) to the surface. The anionic surfactant granules (I) thus obtained had a bulk density of 0.76 g/cm$^3$ and an average particle size of 438 $\mu$m.

Preparation of Detergent of Inventive Product 1

43.9 parts by weight of the builder granules (I) prepared above, 53.1 parts by weight of the anionic surfactant granules (I) prepared above, 1.3 parts by weight of protease granules (granules of trade name: "ALKALI PROTEASE K-16" disclosed in Japanese Patent Laid-Open No. 5-25492, of which the disclosure is incorporated herein by reference, 10 APu/g), 0.5 parts by weight of cellulase granules (granules of trade name: "ALKALI CELLULASE K" disclosed in Japanese Patent Laid-Open No. 63-264699, of which the disclosure is incorporated herein by reference, 800 u/g), and 1.0 part by weight of lipase granules (granules of trade name: "LIPOLASE 100T," manufactured by NOVO Nordisk Bioindustry LTD.) were supplied in a V-type blender. While the components were agitated and blended, 0.2 parts by weight of a perfume were sprayed to the granules for providing them with a fragrance, to give 100.0 parts by weight of the detergent of Inventive Product 1.

Preparation of Detergent of Comparative Product 1

6.9 parts by weight of Spray-Dried Granules L, 50.1 parts by weight of Spray-Dried Granules M, 15.0 parts by weight of Crystalline Alkali Metal Silicate A prepared in Preparation Example 1, 5.0 parts by weight of Amorphous Aluminosilicate prepared in Preparation Example 2, and 0.5 parts by weight of Fluorescent Dye S were supplied in a Lödige Mixer (Matsuzaka Giken Co., Ltd., equipped with a jacket). While agitating at room temperature, the above components were subjected to further granulation by adding 9.6 parts by weight of a polyoxyethylene alkyl ether mixture and 4.5 parts by weight of palmitic acid (trade name: "LUNAC P-95") previously blended at 70° C., the polyoxyethylene alkyl ether mixture comprising 9.0 parts by weight of trade name: "NONIDET R-7" (manufactured by Mitsubishi Chemical Corporation) and 0.6 parts by weight of trade name: "EMULGEN 108" (manufactured by Kao Corporation), and agitating the components. Further, the resulting granules were surface-coated for improving the powder properties by adding 6.0 parts by weight of the zeolite (4A-type) to the surface. The granules of Comparative Product 1 thus obtained had a bulk density of 0.77 g/cm$^3$ and an average particle size of 445 $\mu$m.

97.0 parts by weight of the granules of Comparative Product 1, 1.3 parts by weight of the protease granules (granules of trade name: "ALKALI PROTEASE K-16," disclosed in Japanese Patent Laid-Open No. 5-25492), 0.5 parts by weight of the cellulase granules (granules of trade name: "ALKALI CELLULASE K") and 1.0 part by weight of the lipase granules (granules of trade name: "LIPOLASE 100T") were supplied in a V-type blender. While the components were agitated and blended, 0.2 parts by weight of a perfume were sprayed to the granules for providing them with a fragrance, to give 100.0 parts by weight of the detergent of Comparative Product 1.

The detergency of each of the detergents of Inventive Product 1 and Comparative Product 1 obtained above is evaluated after each detergent is stored under the conditions of 30° C. and 60% RH for a period of 2 weeks in a storage container described below. As a result, the detergency of the detergent of Inventive Product 1 is 56.4%, and that of the detergent of Comparative Product 1, which has the same composition as Inventive Product 1, is 51.2%, clearly indicating that the inventive product has superior detergency to the comparative product.

Detergency Test

Detergents of Inventive Products and Comparative Products prepared above were used to carry out a detergency test under the following conditions:

Preparation of Artificially Stained Cloth

A sheet of cloth (#2003 calico, manufactured by Tanigashira Shoten) was stained with an artificial staining liquid having the following compositions. The artificially stained cloth was produced by printing the artificial staining liquid on the sheet of cloth by an engravure staining machine equipped with an engravure roll coater. The process for staining the cloth with the artificial staining liquid to prepare an artificially stained cloth was carried out under the conditions of a cell capacity of a gravure roll of 58 cm$^3$/cm$^2{}_1$ a coating speed of 1.0 m/min, a drying temperature of 1000° C., and a drying period of time of one minute. The preparation of artificially stained cloth using gravure roll coater are detailed in Japanese Patent Laid-Open No. 7-270395, of which the disclosure is incorporated herein by reference.

| Composition of Artificial Staining Liquid | |
|---|---|
| Myristic acid | 1.8% by weight |
| Palmitic acid | 3.5% by weight |
| Oleic acid | 9.6% by weight |
| Linoleic acid | 1.1% by weight |
| Triolein | 12.5% by weight |
| Squalene | 6.0% by weight |
| Egg white lecithin crystalline liquid | 2.0% by weight |
| Kanuma sekigyoku soil | 7.98% by weight |
| Carbon black | 0.02% by weight |
| Tap water | Balance |

Washing Conditions

Washing of the above-mentioned artificially stained cloth with 3.5° DH water is carried out by using turgometer at a rotational speed of 100 rpm, at a temperature of 20° C. for 10 minutes, and washing was carried out with detergents of Inventive Product 1 and Comparative Product 1. Here, the typical water hardness-increasing components (namely minerals) in the water for washing are $Ca^{2+}$ and $Mg^{2+}$. The ratio of $Ca^{2+}$ to $Mg^{2+}$ is generally within the range of Ca/Mg=60/40 to 85/15. In the present test, tap water is used. The unit "° DH" refers to a water hardness which was calculated by replacing Mg ions with equimolar amounts of Ca ions.

Calculation of Detergency

Reflectivities of the original cloth and those of the stained cloth before and after washing were measured at a wavelength of 550 nm by means of an automatic recording colorimeter (manufactured by Shimadzu Corporation). The detergency D (%) was calculated by the following equation.

$$D = \frac{(L_2 - L_1)}{(L_0 - L_1)} \times 100\ (\%),$$

wherein $L_0$: Reflectivity of the original cloth;

$L_1$: Reflectivity of the stained cloth before washing; and $L_2$: Reflectivity of the stained cloth after washing.

Storage Container

Figure 3:
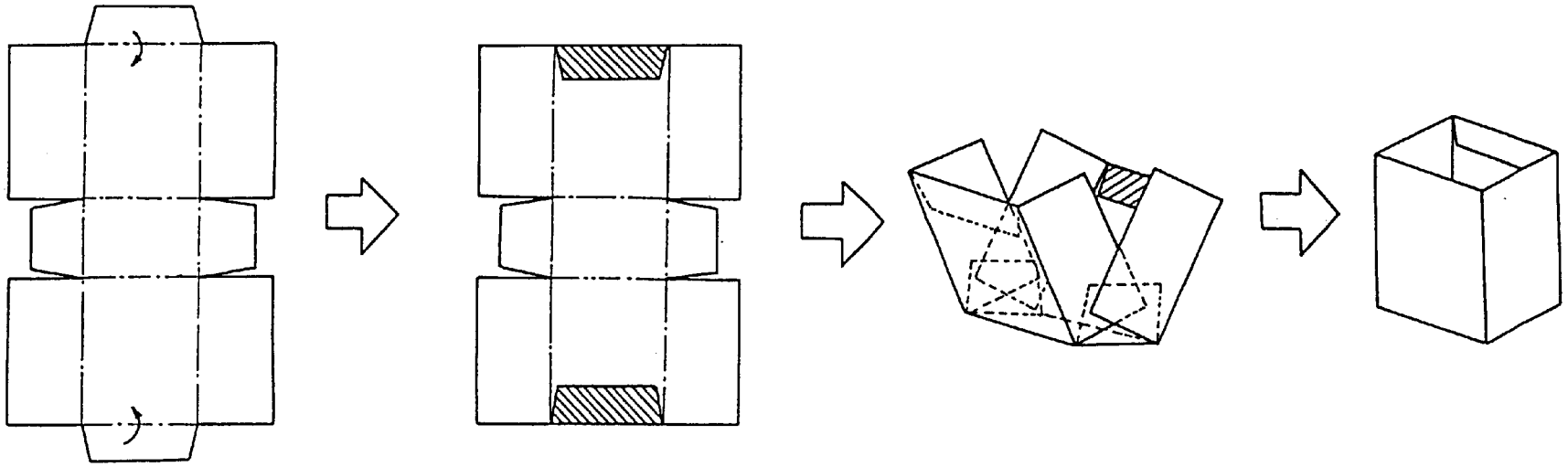
FIG. 3 schematically shows the production process of the paper container used in storing the detergents in the working examples.

A carton made of craft paper of a size of 640 g/m$^2$ laminated with polypropylene to a thickness of 20 $\mu$m is formed by folding the laminated craft paper as shown in FIG. 3, the carton having dimensions of a length of 80 mm, a width of 135 mm, and a height of 110 mm, respectively. An amount 750 g of each detergent is packed in the produced carton, and a lid made of an acrylic plate which is a little larger than the open top of the carton is placed on the carton.

EXAMPLE 2

Preparation of Builder Granules (II)

2.0 parts by weight of a zeolite (4A-type, average particle size: 3 $\mu$m, CEC=280 $CaCO_3$ mg/g, manufactured by Tosoh Corporation), 1.0 part by weight of a sodium polyacrylate (weight-average molecular weight: 10,000, manufactured by Kao Corporation), and 1.0 part by weight of sodium sulfate were added to prepare an aqueous slurry of 50% by weight solid content. The resulting slurry was spray-dried using a countercurrent flow spray drier, to give Spray-Dried Granules N having a water content of 5% by weight of the dead weight. Thereafter, 4.2 parts by weight of Spray-Dried Granules N, 8.0 parts by weight of Crystalline Alkali Metal Silicate B (trade name: "SKS-6," manufactured by Hoechst-Tokuyama, CEC=245 $CaCO_3$ Mg/g), 2.0 parts by weight of Amorphous Aluminosilicate prepared in Preparation Example 2, and 0.5 parts by weight of Fluorescent Dye S were supplied in a Lödige Mixer (Matsuzaka Giken Co., Ltd., equipped with a jacket). The components were agitated while keeping the jacket temperature at 70° C. Subsequently, the above components were subjected to further granulation by blending in advance at 70° C. to prepare a mixture comprising 4.5 parts by weight of a polyoxyethylene alkyl ether (trade name: "NONIDET R-7," manufactured by Mitsubishi Chemical Corporation) and 2.0 parts by weight of a polyethylene glycol (weight-average molecular weight: 7,000, manufactured by Kao Corporation), and spraying the resulting mixture to the above components in the mixer. Further, the resulting granules were surface-coated for improving the powder properties by adding 3.0 parts by weight of the zeolite (4A-type) to the surface. The builder granules (II) thus obtained had a bulk density of 0.84 g/cm$^3$ and an average particle size of 415 $\mu$m.

Preparation of Anionic Surfactant Granules (II)

1.0 part by weight of a polyoxyethylene alkyl ether (trade name: "EMULGEN 108," manufactured by Kao Corporation), 20.0 parts by weight of a sodium linear alkylbenzenesulfonate of which alkyl moiety has 12 carbon atoms, 6.0 parts by weight of a sodium alkyl sulfate of which alkyl moiety has 14 carbon atoms, 1.0 part by weight of a sodium salt of beef tallow fatty acid, 3.0 parts by weight of a sodium polyacrylate (weight-average molecular weight: 10,000, manufactured by Kao Corporation), 15.0 parts by weight of the zeolite (4A-type), 10.0 parts by weight of sodium carbonate, 2.0 parts by weight of potassium carbonate, 5.0 parts by weight of JIS No. 1 Sodium Silicate, 1.5 parts by weight of sodium sulfate, 1.0 part by weight of sodium sulfite, 0.1 parts by weight of Fluorescent Dye S, and 0.2 parts by weight of Fluorescent Dye T (trade name: "CINOPEARL CBS-X," manufactured by Ciba Geigy AG) were added to prepare an aqueous slurry of 50% by weight solid content. The resulting slurry was spray-dried using a countercurrent flow spray drier to give Spray-Dried Granules P having 6% by weight of water content of the dead weight. An amount 70.0 parts by weight of Spray-Dried Granules P thus obtained was then supplied in a High-Speed Mixer (manufactured by Fukae Powtec Corp.), and the spray-dried granules were subjected to granulation. Further, the resulting granules were surface-coated for improving the powder properties by adding 4.0 parts by weight of the zeolite (4A-type) to the surface. The anionic surfactant granules (II) thus obtained had a bulk density of 0.75 g/cm$^3$ and an average particle size of 446 $\mu$m.

Preparation of Detergent of Inventive Product 2

23.0 parts by weight of the builder granules (II) prepared above, 74.0 parts by weight of the anionic surfactant granules (II) prepared above, 1.3 parts by weight of the protease granules (granules of trade name: "ALKALI PROTEASE K-16," disclosed in Japanese Patent Laid-Open No. 5-25492), 0.5 parts by weight of the cellulase granules (granules of trade name: "ALKALI CELLULASE K"), and 1.0 part by weight of the lipase granules (granules of trade name: "LIPOLASE 100T") were supplied in a V-type blender. While the components were agitated and blended, 0.2 parts by weight of a perfume were sprayed to the granules for providing them with a fragrance, to give 100.0 parts by weight of the detergent of Inventive Product 2.

Preparation of Detergent of Comparative Product 2

4.2 parts by weight of Spray-Dried Granules N, 70.0 parts by weight of Spray-Dried Granules P, 8.0 parts by weight of Crystalline Alkali Metal Silicate B (trade name: "SKS-6"), 2.0 parts by weight of Amorphous Aluminosilicate prepared in Preparation Example 2, and 0.3 parts by weight of Fluorescent Dye S were supplied in a Lödige Mixer (Matsuzaka Giken Co., Ltd., equipped with a jacket). While agitating at room temperature, the above components were subjected to further granulation by adding 5.5 parts by weight of a polyoxyethylene alkyl ether mixture and 1.0 part by weight of a polyethylene glycol (weight-average molecular weight: 7000, manufactured by Kao Corporation) previously blended at 70° C., the polyoxyethylene alkyl ether mixture comprising 4.5 parts by weight of trade name: "NONIDET R-7" (manufactured by Mitsubishi Chemical Corporation) and 1.0 part by weight of trade name: "EMULGEN 108" (manufactured by Kao Corporation), and agitating the components. Next, the resulting granules were surface-coated for improving the powder properties by adding 7.0 parts by weight of the zeolite (4A-type) to the surface. The granules of Comparative Product 2 thus obtained had a bulk density of 0.79 g/cm$^3$ and an average particle size of 437 $\mu$m.

Further, 97.0 parts by weight of the granules of Comparative Product 2, 1.3 parts by weight of the protease granules (granules of trade name: "ALKALI PROTEASE K-16," disclosed in Japanese Patent Laid-Open No. 5-25492), 0.5 parts by weight of the cellulase granules (granules of trade name: "ALKALI CELLULASE K"), and 1.0 part by weight of the lipase granules (granules of trade name: "LIPOLASE 100T") were supplied in a V-type blender. While the components were agitated, 0.2 parts by weight of a perfume were sprayed to the granules for providing them with a fragrance, to give 100.0 parts by weight of the detergent of Comparative Product 2.

With respect to each of the detergents of Inventive Product 2 and Comparative Product 2 prepared above, detergency is evaluated in the same manner as in Example 1. As a result, the detergency after storage of the detergent of Inventive Product 2 is 53.4%, and that of the detergent of Comparative Detergent 2, which has the same composition as Inventive Product 2, is 48.7%, clearly indicating that the inventive product has superior detergency to the comparative product.

EXAMPLE 3

Preparation of Builder Granules (III)

1.0 part by weight of a sodium alkyl sulfate of which the alkyl moiety has 14 carbon atoms, 6.0 parts of a zeolite (4A type, average particle size: 3 $\mu$m, CEC=280 $CaCO_3$ mg/g, Tosoh Corporation), 3.0 parts by weight of an acrylic acid-maleic acid copolymer (trade name: "SOKALAN CP-5" manufactured by BASF, weight-average molecular weight: 70,000, CEC=380 $CaCO_3$ mg/g), and 2.5 parts by weight of sodium sulfate were added to prepare an aqueous slurry of 50% by weight solid content. The resulting slurry was spray-dried using a counter-current flow spray drier, to give Spray-Dried Granules Q having a water content of 5% by weight of the dead weight. Thereafter, 13.2 parts by weight of Spray-Dried Granules Q, 25.0 parts by weight of Crystalline Alkali Metal Silicate A prepared in Preparation Example 1, 6.8 parts by weight of Amorphous Aluminosilicate prepared in Preparation Example 2, and 0.4 parts by weight of Fluorescent Dye S were supplied in a Lödige Mixer (Matsuzaka Giken Co., Ltd., equipped with a jacket) and agitated with keeping the jacket temperature at 70° C. Subsequently, the above components were subjected to further granulation by blending in advance at 70° C. to prepare a mixture comprising 12.0 parts by weight of a polyoxyethylene alkyl ether (trade name: "NONIDET R-7," manufactured by Mitsubishi Chemical Corporation), 6.0 parts by weight of a beef tallow fatty acid, and 0.5 parts by weight of a polyethylene glycol (weight-average molecular weight: 7000, manufactured by Kao Corporation), and spraying the resulting mixture to the above components in the mixer. Here, a part or a whole part of the fatty acid was neutralized to form a salt of the fatty acid on the surface of Crystalline Alkali Metal silicate A having a high alkalizing ability. Further, the resulting granules were surface-coated for improving the powder properties by adding 4.0 parts by weight of the zeolite (4A-type) to the surface. The builder granules (III) thus obtained had a bulk density of 0.79 g/cm$^3$ and an average particle size of 444 $\mu$m.

Preparation of Anionic Surfactant Granules (III)

9.0 parts by weight of a sodium salt of methyl ester of $\alpha$-sulfosulfuric acid of which alkyl moiety has 14 carbon atoms, 3.0 parts by weight of a sodium alkyl sulfate of which alkyl moiety has 14 carbon atoms, 4.5 parts by weight of the zeolite (4A-type), 4.5 parts by weight of sodium sulfate, 1.0 part by weight of sodium sulfite, and 0.1 parts by weight of Fluorescent Dye S were added to prepare an aqueous slurry of 50% by weight solid content. The resulting slurry was spray-dried using a countercurrent flow spray drier, to give Spray-Dried Granules R having 6% by weight of water content of the dead weight. Thereafter, 23.5 parts by weight of Spray-Dried Granules R, 0.5 parts by weight of sodium carbonate, and 2.0 parts by weight of potassium carbonate were supplied in a ribbon mixer to blend the components. The resulting mixture was subjected to an extrusion granulation using a twin-screw type front extrusion granulator ("PELLETER DOUBLE," manufactured by Fuji Paudal Co., Ltd.) and made compact by forming cylindrical pellets having a diameter of 10 mm. The resulting pellets, together with 2.0 parts by weight of the zeolite (4A-type), were pulverized and granulated to carry out surface coating of the resulting granules in a flush mill (manufactured by Fuji Paudal Co., Ltd.). Coarse-grained products were removed from the resulting granules. The resulting anionic surfactant granules (III) had a bulk density of 0.75 g/cm$^3$ and an average particle size of 466 $\mu$m.

Preparation of Detergent of Inventive Product 3

67.9 parts by weight of the builder granules (III) prepared above, 29.1 parts by weight of the anionic surfactant granules (III) prepared above, 1.3 parts by weight of the protease granules (granules of trade name: "ALKALI PROTEASE K-16," disclosed in Japanese Patent Laid-Open No. 5-25492), 0.5 parts by weight of the cellulose granules (granules of trade name: "ALKALI CELLULASE K"), and 1.0 part by weight of the lipase granules (granules of trade name: "LIPOLASE 100T") were supplied in a ribbon mixer. While agitating and blending the above components, 0.2 parts by weight of a perfume were sprayed to the granules for providing them with a fragrance, to give 100.0 parts by weight of the detergent of Inventive Product 3.

Preparation of Detergent of Comparative Product 3

25.0 parts by weight of Crystalline Alkali Metal Silicate A prepared in Preparation Example 1, 6.8 parts by weight of Amorphous Aluminosilicate prepared in Preparation Example 2, and 0.5 parts by weight of Fluorescent Dye S were supplied in a ribbon mixer, to blend the components. While the components were agitated at room temperature, a mixture previously blended at 70° C., the mixture comprising 12.0 parts by weight of a polyoxyethylene alkyl ether (trade name: "NONIDET R-7" manufactured by Mitsubishi Chemical Corporation), 6.0 parts by weight of a beef tallow fatty acid, and 0.5 parts by weight of a polyethylene glycol (weight-average molecular weight: 7000, manufactured by Kao Corporation), was added to the above components by spraying thereto. Subsequently, 13.2 parts by weight of Spray-Dried Granules Q and 23.5 parts by weight of Spray-Dried Granules R were added to the above, and the components were blended. Thereafter, the resulting mixture was subjected to an extrusion granulation using a twin-screw type front extrusion granulator and made compact by forming cylindrical pellets with a diameter of 10 mm. The resulting pellets, together with 7.0 parts by weight of the zeolite (4A-type), were pulverized and granulated using a flush mill (manufactured by Fuji Paudal Co., Ltd.) to carry out surface coating of the resulting granules. Coarse-grained products were removed from the resulting granules. The resulting granules of Comparative Product 3 had a bulk density of 0.79 g/cm$^3$ and an average particle size of 437 $\mu$m.

97.0 parts by weight of the granules of Comparative Product 3, 1.3 parts by weight of the protease granules (granules of trade name "ALKALI PROTEASE K-16," disclosed in Japanese Patent Laid-Open No. 5-25492), 0.5 parts by weight of the cellulase granules (granules of trade name "ALKALI CELLULASE K"), and 1.0 part by weight of the lipase granules (granules of trade name "LIPOLASE 100T") were supplied in a V-type blender. While agitating and blending the components, 0.2 parts by weight of a perfume were sprayed to the granules for providing them with a fragrance, to give 100.0 parts by weight of the detergent of Comparative Product 3.

With respect to each of the detergents of Inventive Product 3 and Comparative Product 3 prepared above, detergency is evaluated in the same manner as in Example 1. As a result, the detergency after storage of the detergent of Inventive Product 3 is 56.7%, and that of the detergent of Comparative Product 3, which has the same composition as Inventive Product 3, is 49.7%, clearly indicating that the inventive product has notably superior detergency to the comparative product.

In addition, the detergency performance for cases where the water hardness is harder than the water used is evaluated by carrying out a detergency test a detergent of Inventive Product 2. In a case where the water used is 8° DH and a washing temperature is 30° C., it is found that the detergency is not impaired by long-term storage as compared to the comparative products when a detergent concentration is 0.83 g/L. Also, in a case where the water used is 15° DH, a washing time is 30 minutes, and a washing temperature is 40° C., it is found that the detergency is not impaired by long-term storage as compared to the comparative products when a detergent concentration is 2.00 g/L. Incidentally, other washing conditions are the same as above.

INDUSTRIAL APPLICABILITY

According to the high-density granular detergent composition for washing clothes of the present invention, the standard amount of dosage of the detergent composition is remarkably reduced when compared to the conventional compact-type detergent compositions for clothes washing. In addition, in the high-density granular detergent composition of the present invention, a good detergency can be maintained even after long-term storage. Further, since the detergent composition is phosphorus-free, the detergent composition is less likely to cause environmental problems.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A high-density granular detergent composition for clothes washing, the granular detergent composition having a bulk density of from 0.7 to 1.2 g/cm$^3$, comprising:

(A) one or more non-soap anionic surfactants;

(B) one or more crystalline alkali metal silicates; and (C) one or more metal ion capturing agents other than Component (B), wherein Component (A) is added in an amount of from 10 to 50% by weight, and a total amount of Component (B) and Component (C) is from 30 to 80% by weight, wherein a weight ratio of Component (B) to Component (C) is (B)/(C)=1/15 to 5/1, and wherein 80% by weight or more of said (B) crystalline alkali metal silicate is blended in builder granules, the builder granules comprising said crystalline alkali metal silicate, a binder and optionally an aluminosilicate, and wherein (A) the non-soap anionic surfactant is present in the builder granules in an amount of less than 10% by weight.

2. The high-density granular detergent composition for clothes washing according to claim 1, wherein all of said Component (B) is blended in said builder granules.

3. The high-density granular detergent composition for clothes washing according to claim 1, wherein the binder is at least one member selected from the group consisting of polyoxyethylene alkyl ethers, fatty acids, fatty acid salts, and polyethylene glycols.

4. The high-density granular detergent composition for clothes washing according to claim 1 wherein said crystalline alkali metal silicates have $SiO_2/Na_2O$ molar ratios of from 0.5 to 2.6.

5. The high-density granular detergent composition for clothes washing according to claim 1 wherein said builder granules have an average particle size of from 250 to 1000 μm.

6. The high-density granular detergent composition for clothes washing according to claim 1 wherein said crystalline alkali metal silicates have an average particle size of from 1 to 50 μm.

7. The high-density granular detergent composition for clothes washing according to claim 1 wherein said non-soap anionic surfactants are at least one member selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates.

8. The high-density granular detergent composition for clothes washing according to claim 2, wherein the binder is at least one number selected from the group consisting of polyoxyethylene alkyl ethers, fatty acids, fatty acid salts, and polyethylene glycols.

9. The high-density granular detergent composition for clothes washing according to claim 2, wherein said crystalline alkali metal silicates have $SiO_2/Na_2$ molar ratios of from 0.5 to 2.6.

10. The high-density granular detergent composition for clothes washing according to claim 3, wherein said crystalline alkali metal silicates have $SiO_2/Na_2O$ molar ratios of from 0.5 to 2.6.

11. The high-density granular detergent composition for clothes washing according to claim 2, wherein said builder granules have an average particle size of from 250 to 1000 μm.

12. The high-density granular detergent composition for clothes washing according to claim 3, wherein said builder granules have an average particle size of from 250 to 1000 μm.

13. The high-density granular detergent composition for clothes washing according to claim 4, wherein said builder granules have an average particle size of from 250 to 1000 μm.

14. The high-density granular detergent composition for clothes washing according to claim 2, wherein said crystalline alkali metal silicates have an average particle size of from 1 to 50 μm.

15. The high-density granular detergent composition for clothes washing according to claim 3, wherein said crystalline alkali metal silicates have an average particle size of from 1 to 50 μm.

16. The high-density granular detergent composition for clothes washing according to claim 4, wherein said crystalline alkali metal silicates have an average particle size of from 1 to 50 μm.

17. The high-density granular detergent composition for clothes washing according to claim 5, wherein said crystalline alkali metal silicates have an average particle size of from 1 to 50 μm.

18. The high-density granular detergent composition for clothes washing according to claim 2, wherein said non-soap anionic surfactants are at least one member selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates.

19. The high-density granular detergent composition for clothes washing according to claim 3, wherein said non-soap anionic surfactants are at least one member selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates.

20. The high-density granular detergent composition for clothes washing according to claim 4, wherein said non-soap anionic surfactants are at least one member selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates.

21. The high-density granular detergent composition for clothes washing according to claim 5, wherein said non-soap anionic surfactants are at least one member selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates.

22. The high-density granular detergent composition for clothes washing according to claim 6, wherein said non-soap anionic surfactants are at least one member selected from the group consisting of linear alkylbenzenesulfonates, α-olefinsulfonates, α-sulfofatty acid salts, methyl ester salts of α-sulfofatty acids, alkyl sulfates, alkenyl sulfates, and polyoxyethylene alkyl ether sulfates.

* * * * *